US007192108B2

(12) United States Patent
Lyman

(10) Patent No.: US 7,192,108 B2
(45) Date of Patent: Mar. 20, 2007

(54) INK COMPATIBILITY ASSURANCE PROGRAM

(75) Inventor: Dan C. Lyman, Cincinnati, OH (US)

(73) Assignee: Eastman Kodak Company, Rochester, NY (US)

( * ) Notice: Subject to any disclaimer, the term of this patent is extended or adjusted under 35 U.S.C. 154(b) by 273 days.

(21) Appl. No.: 10/839,360

(22) Filed: May 5, 2004

(65) Prior Publication Data

US 2005/0248603 A1 Nov. 10, 2005

(51) Int. Cl.
*B41J 2/175* (2006.01)

(52) U.S. Cl. ..... 347/7; 347/19; 347/106

(58) Field of Classification Search ..... 347/7, 347/19, 106; 101/351.1; 705/77
See application file for complete search history.

(56) References Cited

U.S. PATENT DOCUMENTS

| | | | | |
|---|---|---|---|---|
| 4,403,227 | A | 9/1983 | Bertschy et al. | 346/75 |
| 5,365,312 | A | 11/1994 | Hillman | 355/206 |
| 5,473,350 | A * | 12/1995 | Mader et al. | 347/7 |
| 5,761,566 | A | 6/1998 | Suzuki et al. | 399/12 |
| 5,835,817 | A | 11/1998 | Bullock et al. | 399/25 |
| 6,019,449 | A | 2/2000 | Bullock et al. | 347/14 |
| 6,062,669 | A | 5/2000 | Lee | 347/19 |
| 6,113,208 | A | 9/2000 | Benjamin et al. | 347/7 |
| 6,116,715 | A | 9/2000 | Lefebvre | 347/19 |
| 6,151,039 | A | 11/2000 | Hmelar et al. | 347/7 |
| 6,155,664 | A * | 12/2000 | Cook | 347/7 |
| 6,158,837 | A | 12/2000 | Hilton | 347/19 |
| 6,161,913 | A | 12/2000 | Childers et al. | 347/19 |
| 6,254,211 | B1 | 7/2001 | Simon et al. | 347/6 |
| 6,362,868 | B1 * | 3/2002 | Silverbrook | 355/18 |
| 6,447,090 | B1 * | 9/2002 | Saruta | 347/19 |
| 6,565,184 | B1 | 5/2003 | Numata et al. | 347/23 |
| 6,672,699 | B1 | 1/2004 | Jeong | 347/19 |

(Continued)

FOREIGN PATENT DOCUMENTS

| | | |
|---|---|---|
| EP | 0589130 | 3/1993 |

(Continued)

OTHER PUBLICATIONS

Tanenbaum, Structured Computer Organization, Fourth Edition, Prentice Hall, 1999, p. 39, second-fourth paragraphs.*

*Primary Examiner*—Stephen Meier
*Assistant Examiner*—Lam S. Nguyen
(74) *Attorney, Agent, or Firm*—The Buskop Law Group, P.C.

(57) ABSTRACT

The print station with a controlled fluid system includes a printhead, a reservoir for supplying fluid to the printhead, and a replaceable fluid container containing a replacement fluid. A fluid supply line is connected between the replaceable fluid container and the reservoir, and a fluid line is connected between the reservoir to the printhead. A pump supplies fluid from the reservoir to the printhead. A controllable valve in located in the fluid supply line, and is attached to a controller that provides a controlled release of fluid from the replaceable fluid container to the reservoir. The station includes a sensor for ascertaining the fluid level in the reservoir in communication with the controller, a reader/writer for communicating with the controller, and a smart card adapted to be read by the reader writer. The smart card includes information concerning the replaceable fluid container.

15 Claims, 4 Drawing Sheets

U.S. PATENT DOCUMENTS

| | | | | |
|---|---|---|---|---|
| 6,676,022 | B1 * | 1/2004 | Guthery et al. | 235/492 |
| 6,820,064 | B1 * | 11/2004 | Currans et al. | 705/77 |
| 2001/0019665 | A1 | 9/2001 | Kawakami | 399/12 |
| 2002/0015083 | A1 * | 2/2002 | Thorpe et al. | 347/85 |
| 2002/0064389 | A1 | 5/2002 | Semma et al. | 399/12 |
| 2002/0085050 | A1 | 7/2002 | Aruga et al. | 347/7 |
| 2002/0094207 | A1 | 7/2002 | Richards et al. | 399/8 |
| 2002/0121546 | A1 * | 9/2002 | Clark | 235/383 |
| 2004/0004653 | A1 * | 1/2004 | Pryor et al. | 347/106 |
| 2004/0129156 | A1 * | 7/2004 | Adachi | 101/351.1 |

FOREIGN PATENT DOCUMENTS

| | | |
|---|---|---|
| EP | 0789322 | 1/1997 |
| EP | 0 863 003 | 12/1997 |
| EP | 0813120 | 12/1997 |
| EP | 1 234 673 | 8/2002 |

* cited by examiner

INK COMPATIBILITY ASSURANCE PROGRAM

FIELD OF THE INVENTION

The present embodiments relate to methods of tracking fluid flow and ensuring compatibility of inks and other fluids for continuous ink jet printers.

BACKGROUND OF THE INVENTION

Current ink jet printing systems consist of a fluid system supporting one or more printheads. Typical ink jet printheads operate by forcing fluid through a droplet generator that contains an array of orifices, forming droplets of ink. The type of ink used in the printhead is important; the type of ink used will enhance overall reliability of the system or cause the printhead to fail.

In continuous ink jet printing systems, ink parameters are finely tuned to work in conjunction with the printhead portion of the system. The use of an ink that is not certified to work with a particular system can adversely affect the quality of printing, the frequency of print systems errors, and/or the longevity of print system components.

Since a printhead may be considered a high cost consumable element in the printing system, it is often warranted by the manufacturer to meet certain reliability criteria and, therefore, the manufacturer often ends up absorbing the large cost of a customer's use of non-approved ink in a print system. This is an expense that manufacturers desire to avoid.

Typically, the customer purchases the system with the agreement that the customer must use approved ink. For various reason (i.e., low cost, better short term performance at the expense of reduced printhead life, availability of a specific color, and the like) a customer may be tempted to use non-approved ink.

A need exists for a tracking device to follow the consumption of ink or other fluids by an ink jet printing system. If non-approved ink is being used by the customer, a need exists for a device to let the manufacturer know that the conditions of the warranty have been violated.

Hillmann U.S. Pat. No. 5,365,312 discloses a technique for tracking the use of replaceable ink reservoirs, toner cartridges, and ribbon cassettes by permanently modifying the electronic memory associated with these devices. A drop counting technique is used to determine usage and misusage of ink.

Other systems for detecting ink cartridge status are known in the art, as exampled by Hilton U.S. Pat. No. 6,158,837; Lefebvre U.S. Pat. No. 6,116,715; and Lee U.S. Pat. No. 6,062,669. The prior art listed herein is hereby incorporated by reference.

A need exists for a device that allows the customer to continue to operate while alerting the printhead manufacturer that non-approved ink is being used.

The embodied devices herein are designed to meet these needs.

SUMMARY OF THE INVENTION

The print station with a controlled fluid system is for providing controlled ink to a continuous ink jet printhead. The print station includes a printhead, a reservoir for supplying fluid to the printhead, and a replaceable fluid container containing a replacement fluid. A fluid supply line is connected between the replaceable fluid container and the reservoir. A fluid line is connected between the reservoir and the printhead, and a fluid return line is connected between the printhead and the reservoir. The print station includes a pump disposed in the fluid line to supply fluid from the reservoir to the printhead. A controller is connected to a controllable valve located in the fluid supply line. The controllable valve provides a controlled release of fluid from the replaceable fluid container to the reservoir. The print station includes a sensor for ascertaining the fluid level in the reservoir in communication with the controller; a reader/writer for communicating with the controller; and a smart card adapted to be read by the reader/writer. The smart card includes information concerning the replaceable fluid container.

BRIEF DESCRIPTION OF THE DRAWINGS

In the detailed description of the preferred embodiments presented below, reference is made to the accompanying drawings, in which.

DETAILED DESCRIPTION OF THE INVENTION

Figure 1:
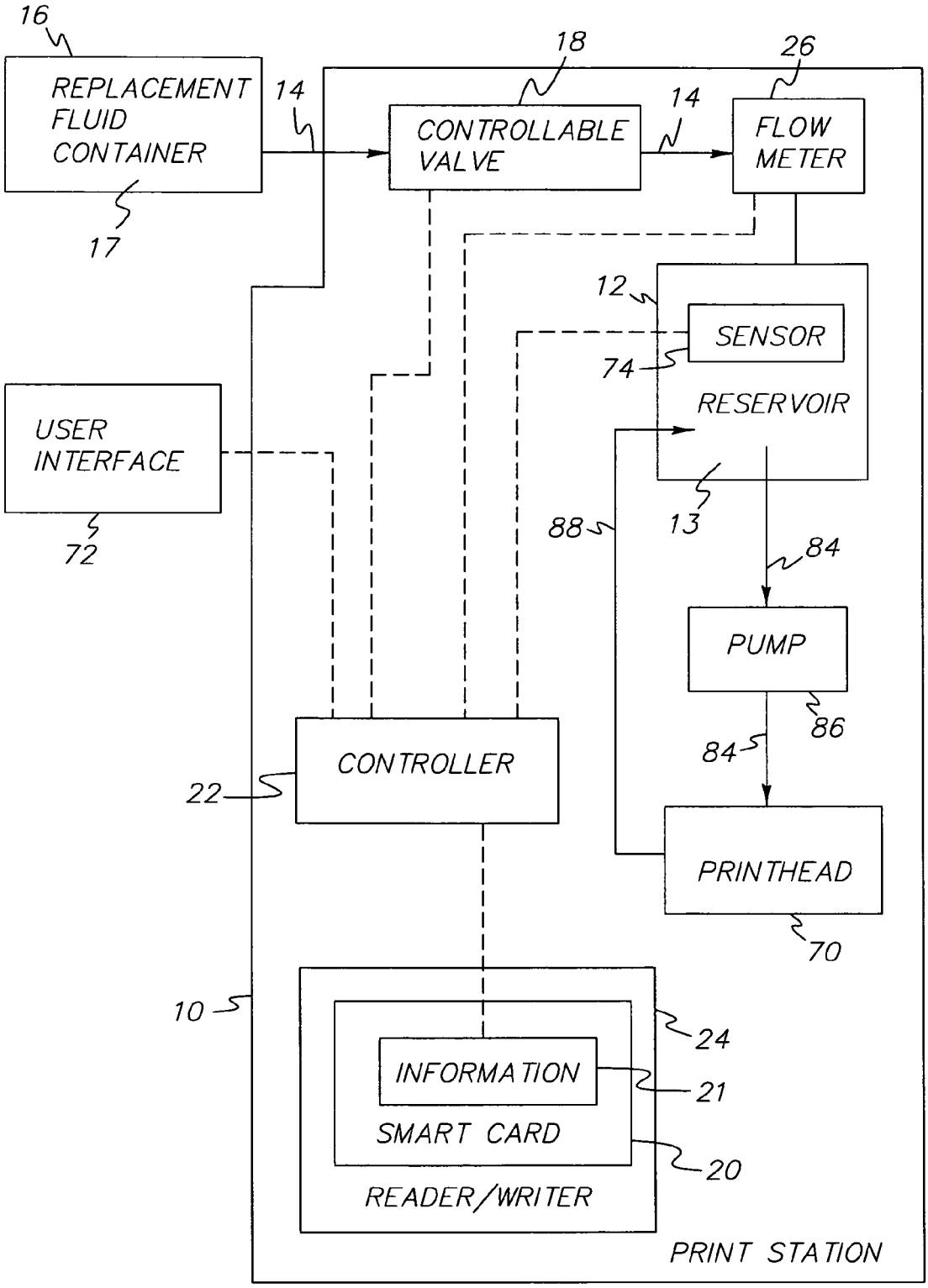
FIG. 1 depicts an overall schematic of a printing system and a smart card.

Before explaining the present embodiments in detail, it is to be understood that the embodiments are not limited to the particular descriptions and that it can be practiced or carried out in various ways.

The embodied print stations provide a manner for providing controlled ink to a continuous ink jet printhead. The print station uses a smart card that can relate information to the printhead manufacturer regarding inks that are used by a customer.

Often, if a customer uses ink that is not approved by a manufacturer, the life of the printhead can be dramatically reduced and/or the printhead can be damaged and ultimately non-refurbishable, which is wasteful for recycling and environmental purposes.

If the wrong ink is used in the printing device, the device can completely break down or fail because other parameters for the printing machine have not been reset due to the use of wrong ink. The present device was designed to maximize the longevity and reduce repair needs for a printing system by tracking a customer's use of approved inks and fluid.

The system assists in minimizing the extent to which a manufacturer is financially exposed when a customer damages a printhead by using uncertified ink and returns the printhead to the manufacturer for replacement.

The system assists in preventing the use of two incompatible but approved inks in the printing system. The device thereby helps insure proper flushing of the print station occurs between two approved inks where if a second ink was used after a first ink, clogging could occur.

An embodiment of the print station with a controlled fluid system includes a printhead. The printhead is in communication with a reservoir that supplies fluid to the printhead by a fluid line. The reservoir is connected to a replaceable fluid container containing a replacement fluid by a fluid supply line. A pump is engaged with the fluid line to supply fluid from the reservoir to the printhead. A fluid return line communicates from the printhead to the reservoir. A controllable valve is disposed in the fluid supply line to open and close the fluid supply line. A controller communicates with the controllable valve to provide a controlled release of fluid from the replaceable fluid container to the reservoir. A reader/writer communicates with the controller to read and write to a smart card having information concerning the replaceable fluid container.

The preferred embodiment of a smart card that is a credit card sized plastic card with a chip contained in the card that can securely store information and link to other devices to securely transmit data embedded in the chip. With a smart card variation, the information can be securely stored and retrieved.

In an embodiment, the smart card is distributed with each replaceable container having fluid, such as water-based ink.

The smart card allows the print station to track the usage of ink from the replaceable container. Each time the system fills with ink, the smart card can track the use and provide volumetric credits against that fluid usage can be debited. If the credits reach zero, the reservoir can still be filled, but the print station controller will indicate to a user interface or to the printhead that filling of the reservoir is occurring with non-approved inks.

With reference to the Figures, FIG. 1 depicts an ink jet print station 10, such as a Kodak Versamark DT92 print station available from Kodak Versamark of Dayton, Ohio. The print station has a printhead 70 connected to a reservoir 12 for holding fluid 13 usable by the print station for cleaning or for printing.

A fluid supply line 14 communicates with the reservoir 12 and a replaceable fluid container 16. The replaceable fluid container 16 can hold fluid for the print station. The fluid 17 can be ink, cleaning fluid, a replenishment fluid or combinations of these fluids.

A controllable valve 18 is disposed in the fluid supply line 14 for controlling fluid flow through the fluid supply line 14. The controllable valve is controlled by a controller 22 that in turn receives information from a reader/writer 24. The smart card 20 has information 21 concerning the replaceable fluid container 16. The information on the smart card 20 can be read by the reader/writer 24. After the controller 22 has received information from the smart card 20, the controller can provide a controlled release of fluid 13 from the replaceable container 16 to the reservoir.

A flow meter 26 can optionally be disposed in the fluid supply line 14 and be in communication with the controller 22.

The print station can have a user interface 72 in communication with the controller 22 enabling the controller 22 to advise a user that the fluid in the reservoir is not compatible with the print station. The print station can advise a user that a valid smart card with volume remaining on the card is in use. The print station can provide other messages as well, such as messages that the new ink of a second replaceable container is not compatible with the ink of the reservoir or that flushing needs to occur prior to use of the new ink of the second replaceable container. Other example e messages the print station can provide include a message that the expiration date for fluid in the replaceable container has passed, a message that a smart card has not been installed, and a message that the smart card volumetric credits are low.

The print station has a sensor 74 for measuring the level of fluid in the container that is in communication with the controller.

The print station has a fluid line 84 connected between the reservoir to the printhead. A pump 86 is disposed in the fluid line to supply fluid from the reservoir to the printhead. Additionally, the print station has a fluid return line 88 from the printhead to the reservoir.

An example of a smart card useable with the print station is model MPCOS-EMV16K available from GemPlus of Luxembourg. An exemplary smart card reader for reading from and writing to the smart card is model 410 available from GemPlus of Luxembourg. The smart card preferably is one that complies with the ISO standard ISO 7816.

The controller can be a central processing unit (CPU) or a gate array logic device. The controller can conjunctively operate the print station. The gate array logic device can be a model Spartan XC2S100E available from Xilinx.

The reservoir 12 can have a capacity between one liter and six liters. It is envisioned that the replaceable container can have capacity between 1 liter and 220 liters.

The fluid of the reservoir or the replaceable fluid container can be water-based ink, oil-based ink, solvent-based ink, cleaning fluid, replenishment fluid, or a toner. An example of an ink that could be used in the print station is model FD7101 from Kodak Versamark of Dayton, Ohio. An example of a cleaning fluid is model FF5000 from Kodak Versamark of Dayton, Ohio. An example of a replenishment fluid is product number FR1014 from Kodak Versamark of Dayton, Ohio.

The fluid supply line can be flexible tubing having an inner diameter between 0.25 cm and 2.5 cm, which is compatible with the fluid.

The controllable valves are preferably motor valves, solenoid valves, hydraulic valves, pneumatic valves, or other electrically controlled valves.

Figure 2:
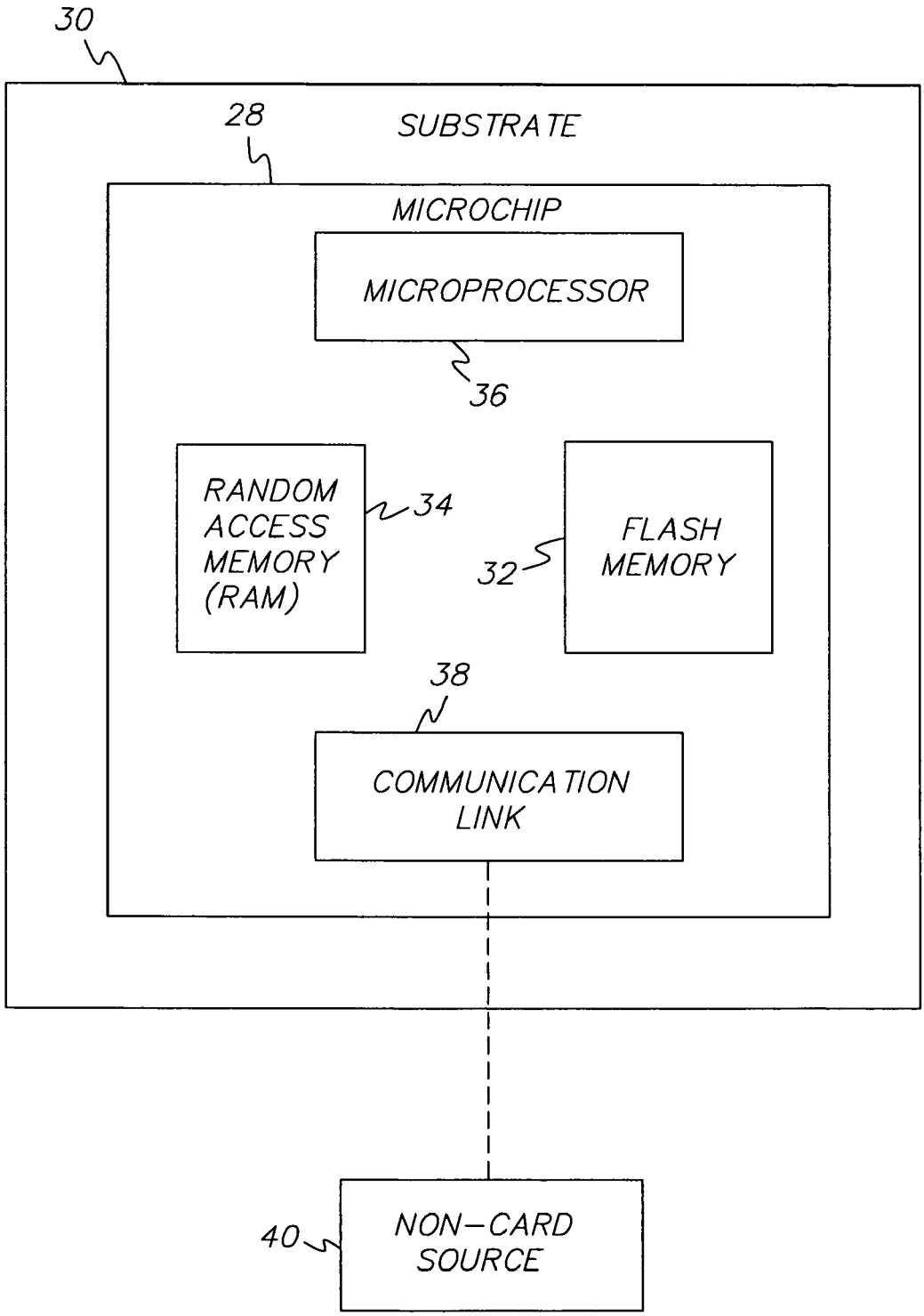
FIG. 2 depicts a representative view of the components of the smart card.

FIG. 2 depicts a preferred embodiment of a smart card usable in the print station of the invention. The smart card includes a microchip 28 embedded in a substrate 30, wherein the microchip has flash memory 32, random access memory (RAM) 34, a microprocessor 36, and a communication link 38 for transmitting and receiving data from a non-card source 40.

Figure 3:
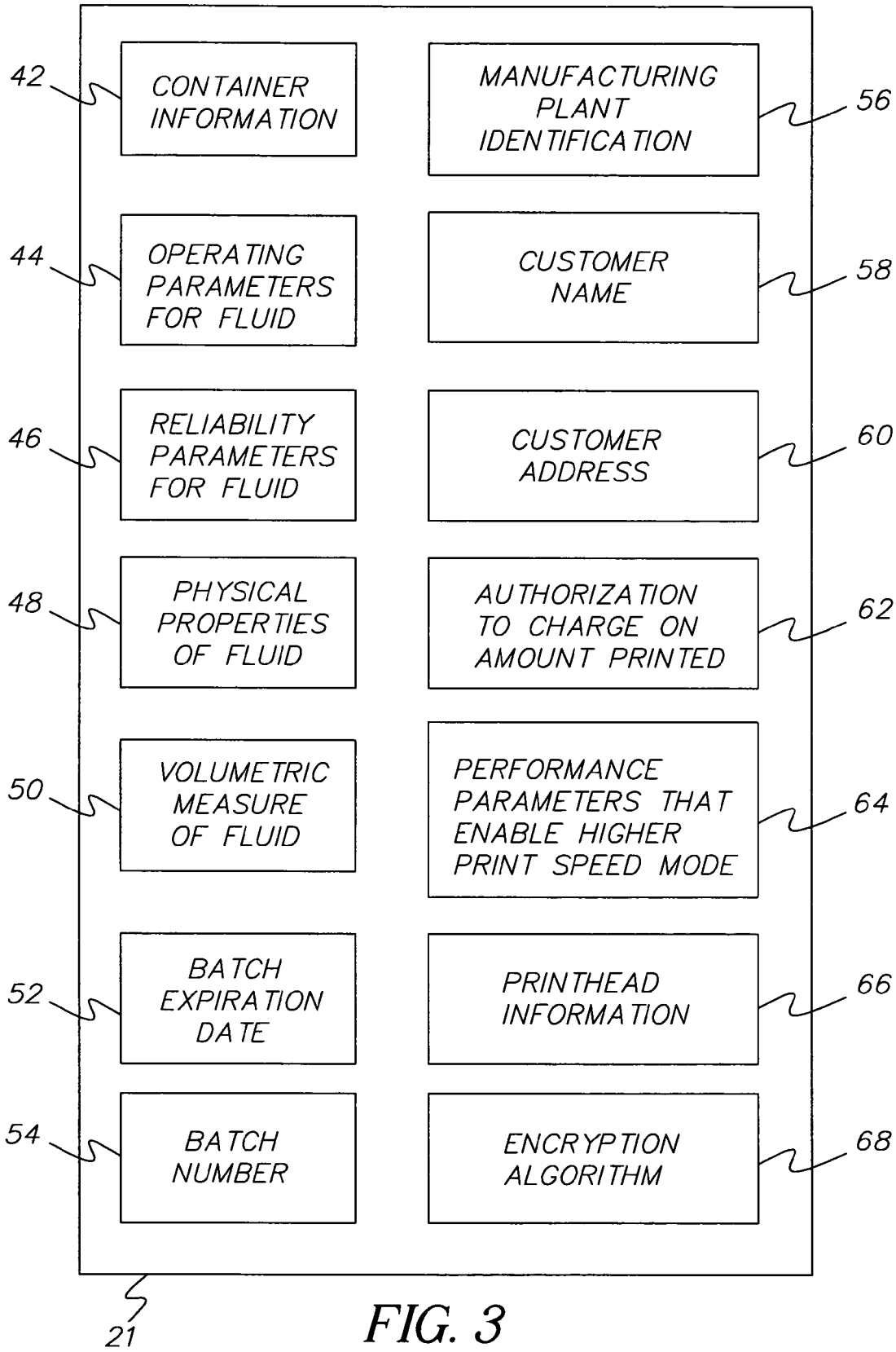
FIG. 3 depicts a graphic representation of the data fields that can be stored on the smart card.

FIG. 3 shows the smart card with the following information stored on the card, information about the container 42, operating properties of the fluid 44, reliability properties of the fluid 46, specifications on the physical properties of fluid in the container 48, volumetric measurements on the fluid in the container 50, batch expiration dates 52, batch number 54, manufacturing plant identification information 56, customer name 58, customer address 60, authorization to charge based on amount printed 62, performance parameters that enable the system run faster for a defined period of time 64, printhead information 66. The smart card can also include a security encryption algorithm 68 to prevent unauthorized communication with the smart card.

Figure 4:
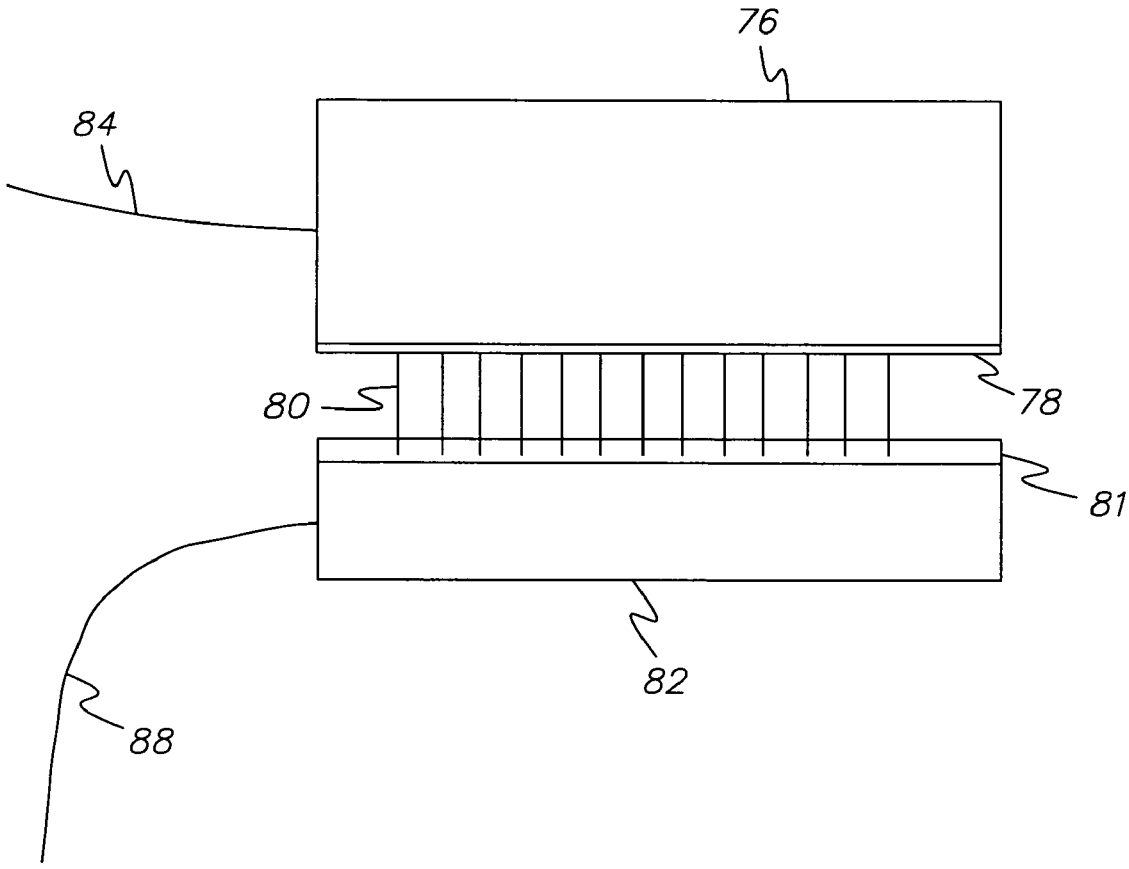
FIG. 4 depicts a printhead that operates within the print station of the device The present embodiments are detailed below with reference to the listed Figures.

FIG. 4 shows an embodiment of an ink jet printhead usable in this invention, more specifically, a drop generator 76 has an orifice structure 78 attached to the drop generator forming a jet array 80. Disposed opposite the jet array is an optional charge device 81 connected to a catcher 82. The drop generator is supplied with fluid from a fluid line 84. The catcher 82 communicates to a fluid return line 88 to return fluid from the catcher to the reservoir 12.

The ink fill rate can be determined using the flow meter 26. Operationally, the smart card and smart card reader will function as follows: upon installation of a replaceable fluid container, for example, one with an ink, the operator inputs the ink number "xxx" at the user interface that communicates to the controller.

The, smart card associated with the replaceable fluid container is inserted into the smart card reader. The smart card stays in the reader while the replaceable fluid container is connected to the reservoir.

The controller periodically checks the smart card. If the ink number input to the controller "xxx" does not match the number read from the smart card, the controller generates a message to the user interface, such as "Incorrect Ink Attached". The smart card may have number "xyx" not "xxx".

If the controller does not detect a smart card in the smart card reader, the controller issues a message, such as "Ink Card Not Installed", to the user interface.

A file on the particular ink input by the operator "xxx" and on the accompanying smart card that has in number "xxx" contains information necessary for proper operation of the ink "xxx" with this particular type of printhead "PH92" that is termed here "the inkdex file".

During startup and whenever a new smart card has been installed, the system will check the version number on the smart card's inkdex file and compare the version number to version number being run on the system. If the smart card version is more recent, the system will automatically transfer the smart card version onto the system processor and reload the inkdex file. Other information will be stored on the smart card, such as "date of manufacture", "batch number", and "expiration date". If upon querying the smart card and system determines that the expiration date on the ink has passed, the system will issue a warning, such as Ink Shelf Life Expired".

The fluid system of the print station usually operates under a vacuum. When the controller determines that more ink is required, the ink fill valve is opened allowing ink to flow from the external ink reservoir to the internal ink tank and though the flow senor. The flow sensor reports the flow rate or volumetric usage electronically to the controller.

A signal is sent to the printhead to set the "Invalid Ink Used" bit irreversibly in the printhead memory.

Smart cards are used because the memory is secure in the following respects: (a) the smart card output cannot be emulated by another device; (b) the smart card cannot be "re-charged" (i.e., memory locations on the card cannot be written to over the secure interface, since only the processor knows the encryption algorithm and keys); and (c) the smart card memory cannot be copied.

Additionally, the smart card memory is non-volatile and requires no external power for memory retention. In an alternative embodiment, any secure memory device can be used. The smart card embodiment uses various algorithms to encrypt information, but one skilled in the art will recognize many algorithms and keys that can be used to secure code exchange.

The embodiments have been described in detail with particular reference to certain preferred embodiments thereof, but it will be understood that variations and modifications can be effected within the scope of the embodiments, especially to those skilled in the art.

PARTS LIST

10. print station
12. reservoir
13. fluid
14. fluid supply line
16. replaceable fluid container
17. replacement fluid
18. controllable valve
20. smart card
21. information
22. controller
24. reader/writer
26. flow meter
28. microchip
30. substrate
32. flash memory
34. random access memory (RAM)
36. microprocessor
38. communication link
40. non-card source
42. data—information about container
44. data—operating properties of fluid
46. data—reliability properties of fluid
48. data—specifications on the physical properties of fluid in container
50. data—volumetric measurements on fluid in container
52. data—batch expiration date
54. data—batch number
56. data—manufacturing plant identification number
58. data—customer name
60. data—customer address
62. data—authorization to charge based on amount printed
64. data—performance parameters
66. data—printhead information
68. security encryption algorithm
70. printhead
72. user interface
74. sensor
76. drop generator
78. orifice structure
80. jet array
81. charge device
82. catcher
84. fluid line
86. pump
88. fluid return line

What is claimed is:

1. A print station with a controlled fluid system comprising:

a. a printhead;

b. a reservoir for containing a useable fluid and that is in communication with the printhead to supply the useable fluid to the printhead;

c. a replaceable fluid container containing a replacement fluid;

d. a fluid supply line connected between the replaceable fluid container and the reservoir;

g. a fluid return line from the printhead to the reservoir;

h. a controllable valve disposed in the fluid supply line for controlling fluid flow through the fluid supply line from the replaceable fluid container and the reservoir;

i. a controller communicating with the controllable valve to provide a controlled fluid release from the replaceable fluid container to the reservoir, and indicating that filling of the reservoir is occurring with a non-approved fluid;

l. a smart card for storing information concerning the replaceable fluid container, including information concerning an approved fluid that is used in the print station; and m. a reader/writer that reads from and writes to the smart card, and that communicates with the controller to provide information on the smart card to the controller for the controller to communicate with the controllable valve and for the controller to indicate filling of the reservoir is occurring with a non-approved fluid.

2. The print station of claim 1, wherein the printhead comprises a drop generator with orifice structure fonning ajet array and a catcher.

3. The print station of claim 1, wherein the replacement fluid based ink, cleaning fluid, toner, and replenishment fluid is selected from the group consisting of water-based ink, oil-based ink, solvent-based ink, cleaning fluid, toner and replenishment fluid.

4. The print station of claim 1, wherein the printhead is a continuous ink jet printhead.

5. The print station of claim 1, wherein the reservoir comprises a capacity between one liter and six liters.

6. The print station of claim 1, wherein the replaceable fluid container comprises a capacity between 1 liter and 220 liters.

7. The print station of claim 1, wherein the fluid supply line is flexible tubing comprising an inner diameter between 0.25 cm and 2.5 cm, wherein the flexible tubing is compatible with the fluid.

8. The print station of claim 1, wherein the controllable valve is selected from the group consisting of motor valves, solenoid valves, hydraulic valves, pneumatic valves, and other electrically controlled valves.

9. The print station of claim 1, further comprising a flow meter disposed in the fluid supply line in communication with the controller.

10. The print station of claim 1, wherein the smart card comprises a microchip embedded in a substrate, wherein the microchip comprises flash memory, random access memory (RAM), a microprocessor, and a communication link connected to the microprocessor, and wherein the communication link is adapted to transmit and receive data from a non-card source.

11. The print station of claim 1, wherein the smart card comprises data including:

a. information about the replaceable container;

b. operating properties of the fluid;

c. reliability properties of the fluid;

d. specifications on the physical properties of fluid in the container;

e. volumetric measurements on the fluid in the container;

f. batch expiration dates;

g. batch number, h. manufacturing plant identification information;

i. customer name;

j. customer address;

k. authorization to charge based on amount printed;

l. performance parameters that enable the system run faster for a defined period of time;

m. printhead information; and n. combinations thereof.

12. The print station of claim 1, wherein the smart card further comprises a security encryption algorithm to prevent unauthorized communication with the smart card.

13. The print station of claim 1, wherein the controller is a central processing unit (CPU) or a gate array logic device.

14. The print station of claim 1, wherein the controller is adapted to write a message to a printhead of the print station when a user uses a fluid that is not a verified compatible fluid.

15. The print station of claim 1, further comprising a user interface in communication with the controller enabling the controller to advise a user that the fluid is not compatible with the printhead, to advise the user that a valid smart card with volume remaining is in use, or combinations thereof.

* * * * *